United States Patent [19]

Hayasaka

[11] Patent Number: 5,044,965

[45] Date of Patent: Sep. 3, 1991

[54] OUTPUT TERMINAL STRUCTURE FOR A PAGING RECEIVER

[75] Inventor: Shigeki Hayasaka, Tokyo, Japan

[73] Assignee: NEC Corporation, Japan

[21] Appl. No.: 530,659

[22] Filed: May 29, 1990

[30] Foreign Application Priority Data

May 31, 1989 [JP] Japan ..... 1-63274[U]

[51] Int. Cl.[5] ..... H01R 9/09

[52] U.S. Cl. ..... 439/76; 439/83; 439/830

[58] Field of Search ..... 439/76, 81, 83, 830, 439/853, 876, 890, 910

[56] References Cited

U.S. PATENT DOCUMENTS

| | | | |
|---|---|---|---|
| 4,533,889 | 8/1985 | Knight | 439/83 |
| 4,774,550 | 9/1988 | Igarashi | 439/830 |
| 4,863,389 | 9/1989 | Kobari et al. | 439/83 |
| 4,909,745 | 3/1990 | Hayashi | 439/76 |

*Primary Examiner*—Paula A. Bradley

*Attorney, Agent, or Firm*—Laff, Whitesel, Conte & Saret

[57] ABSTRACT

An output terminal structure for electrically connecting a paging receiver in a printer capable of printing out information received by the receiver. A retaining portion is formed integrally with a case of a battery containing portion which is included in the paging receiver. Connecting pieces each is implemented as a thin flat piece of metal and provided with a single leg. Each connecting piece is received in respective one of slots which are formed in the retaining portion, and the leg of the connecting piece is soldered to a printed circuit board which is incorporated in the receiver. Each connecting piece has a contact surface that contacts a contact terminal member provided in the printer through a window which is formed through the retaining portion, thereby electrically connecting the receiver to the printer.

7 Claims, 4 Drawing Sheets

OUTPUT TERMINAL STRUCTURE FOR A PAGING RECEIVER

BACKGROUND OF THE INVENTION

The present invention relates to a paging receiver and, more particularly, to the structure of an output terminal of a paging receiver for electrically connecting the receiver to a printer which is operable to record received information.

Some modern paging receivers are operated with a printer for printing out received information. This kind of paging receiver includes a casing and an output terminal in the form of a plurality of connecting pieces each being provided on a part of the casing and having a contact surface. On the other hand, a printer has a casing which includes a slot for receiving a part of the receiver casing where the output terminal is positioned. A connecting terminal implemented by a plurality of contact members is disposed in the printer casing in a position corresponding to the connecting pieces of the output terminal of the receiver casing. When the above-mentioned part of the receiver casing is inserted in the slot of the printer, the contact surfaces of the connecting pieces of the receiver are brought into contact with the contact members of the printer, thereby setting up electrical connection of the receiver to the printer. Each connecting piece of the receiver is usually produced by bending a thin piece of metal in the form of a letter U and removing a part of the piece of metal to form a plurality of legs. The legs of each connecting piece are inserted in holes formed through a printed circuit board which is loaded in the paging receiver, and then soldered or otherwise affixed to the board.

The problem with the prior art output terminal structure stated above is that each connecting piece has to be bent in a U configuration to have sufficient strength or rigidity and has to be provided with a plurality of legs to be accurately positioned on and firmly retained by the printed circuit board. Such connecting pieces are, therefore, extremely complicated in configuration and need complicated and troublesome machining and fixing operations.

SUMMARY OF THE INVENTION

It is therefore an object of the present invention to provide an output terminal structure for a paging receiver which is easy to produce and can be readily affixed to a printed circuit board.

It is another object of the present invention to provide an output terminal structure for a paging receiver which can be accurately positioned on and firmly retained by a printed circuit board.

It is another object of the present invention to provide a generally improved output terminal structure for a paging receiver.

An output terminal structure for electrically connecting a paging receiver to a printer capable of printing out information received by the paging receiver of the present invention comprises a receiver casing loaded with a printed circuit board thereinside and having a case of a battery containing portion, a plurality of terminal members each having a contact surface and a single leg which is affixed to the printed circuit board and electrically connected to circuitry provided on the printed circuit board, and a retaining member formed integrally with the case of the battery containing portion and comprising slots each receiving respective one of the terminal members and windows each causing respective one of the terminal members received the slots to show. The contact surface of each terminal member contacts a contact terminal member of the printer through associated one of the windows.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
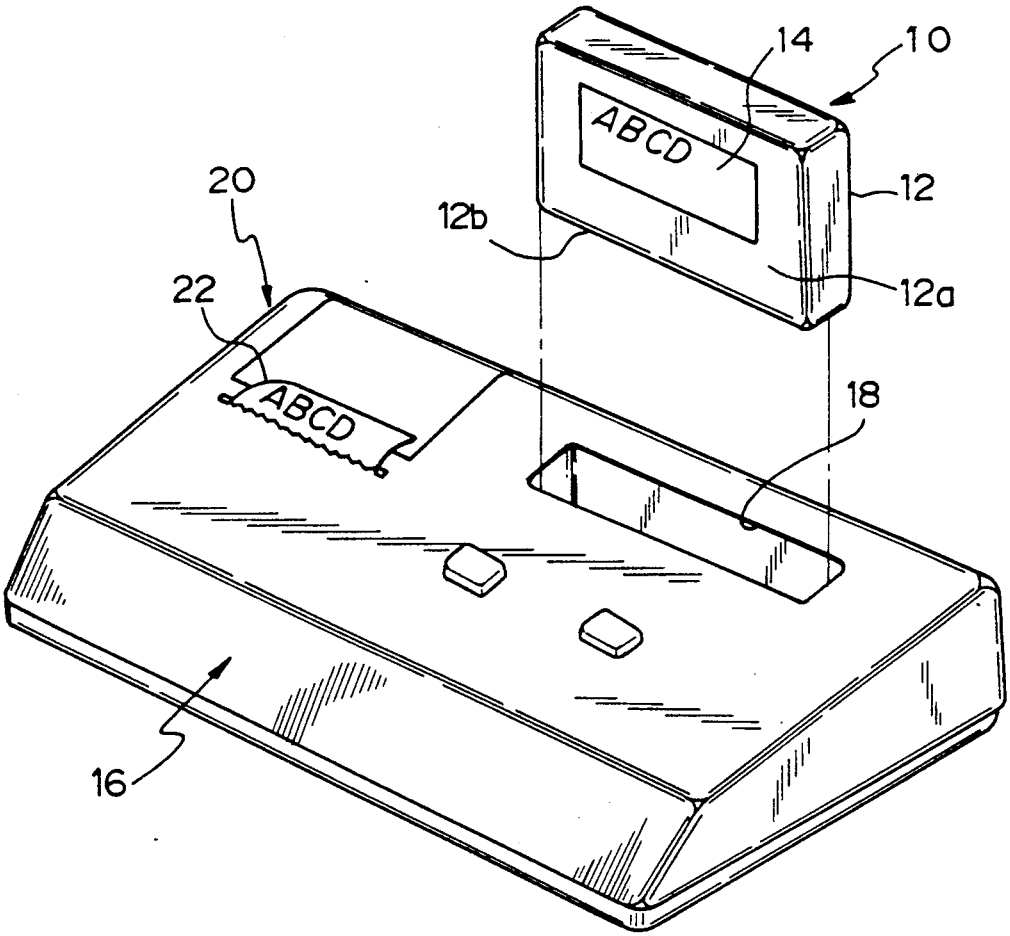
Fig. 1 PRIOR ART
FIG. 1 is a perspective view of a prior art paging receiver and a printer associated therewith.

To better understand the present invention, a brief reference will be made to a prior art output terminal structure for a paging receiver, shown in FIGS. 1 to 3. As shown in FIG. 1, the paging receiver, generally 10, has a casing 12 on one major surface 12*a* of which a liquid crystal display or similar display 14 is provided for displaying alphanumeric characters, kana (Japanese syllabary), kanji (Chinese characters), etc. An output terminal which will be described is arranged on the bottom 12*b* of the casing 12. A printer 16 with which the receiver 10 is operable has a slot 18 for receiving a part of the receiver casing 12 which is close to the bottom 12*b*, and a printing section 20 for printing out received information on a paper sheet 22. A contact terminal which will also be described is positioned on the bottom of the slot 18. When the part of the receiver casing 12 adjacent to the bottom 12*b* is received in the slot 18 of the printer 16, the receiver 10 is electrically connected to the printer 16 by the output terminal of the receiver 10 and the contact terminal of the printer 16. In this condition, information received by the receiver 10 may be printed out on the paper sheet 22 by the printing section 20.

Figure 2:
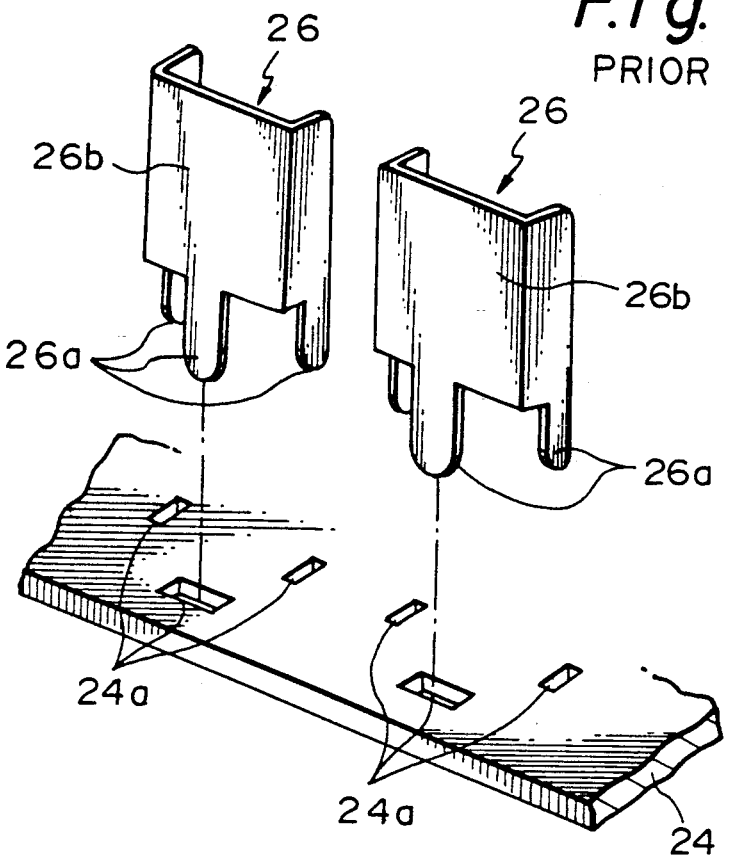
Fig. 2 PRIOR ART
FIG. 2 is a fragmentary exploded perspective view showing an output terminal structure for connecting the prior art paging receiver to the printer.
Figure 3:
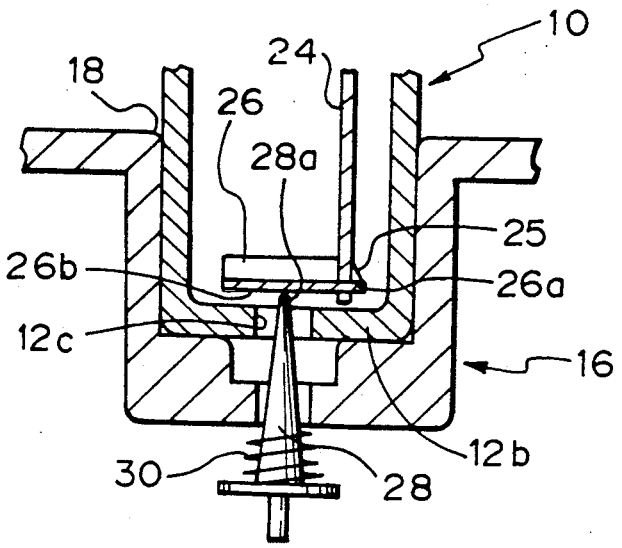
Fig. 3 PRIOR ART
FIG. 3 is a fragmentary section showing the paging receiver with the output terminal structure of FIG. 2 in a position loaded in the printer.

As shown in FIGS. 2 and 3, the output terminal of the paging receiver 10 is implemented as connecting pieces 26 each being formed by bending a thin piece of metal in the form of a letter U and partly removed to have legs 26*a* and a contact surface 26*b*. On the other hand, a printed circuit board 24 is accommodated in the receiver 10 and provided with rectangular holes 24*a* adjacent to one edge thereof. The legs 26*a* of each connecting piece 26 are inserted in associated ones of the holes 24*a* of the printed circuit board 24 and then soldered or otherwise affixed to the board 24 as at 25.

As shown in FIG. 3, windows 12*c* are formed through and at the center of the bottom 12*b* of the receiver casing 12. The connecting pieces 26 of the output terminal are positioned such that their contact surfaces 26*b* face the windows 12*c* of the receiver casing 12. Contact terminals 28 are arranged on the bottom wall of the slot 18 of the printer 16, and each is constantly biased upward by a spring 30 as viewed in FIG. 3. When the bottom 12*b* of the receiver 10 is inserted in the slot 18 of the printer 16, the tips 28*a* of the contact terminals 28 are urged against the contact surfaces 26*b* of the individual connecting pieces 26 by the springs 30 to set up electrical connection of the paging receiver 10 and printer 16.

A problem with the prior art output terminal structure described above is that the connecting pieces 26 cannot be accurately positioned or firmly affixed to the printed circuit board 24 unless each of them is provided with a plurality of legs 26*a*, i.e., at least three legs 26*a* as shown in FIG. 2 and have all the legs 26*a* soldered to the board 24 as at 25. Such a configuration not only needs a substantial number of soldering steps but also brings about a fear that the connecting pieces 26 are affixed to the printed circuit board 24 in an inclined position. Affixing the connecting pieces 26 to the printed circuit board 24 while preventing them from inclining is extremely troublesome. Further, bending each connecting piece 26 in the form of a letter U complicates the fabricating procedure and increases the cost, although it may be successful in enhancing the rigidity or strength of the pieces 26.

A preferred embodiment of the output terminal structure for a paging receiver in accordance with the present invention will be described hereinafter. In the figures, the same or similar structural parts and elements are designated by like reference numerals, and redundant description will be avoided for simplicity.

Figure 4:
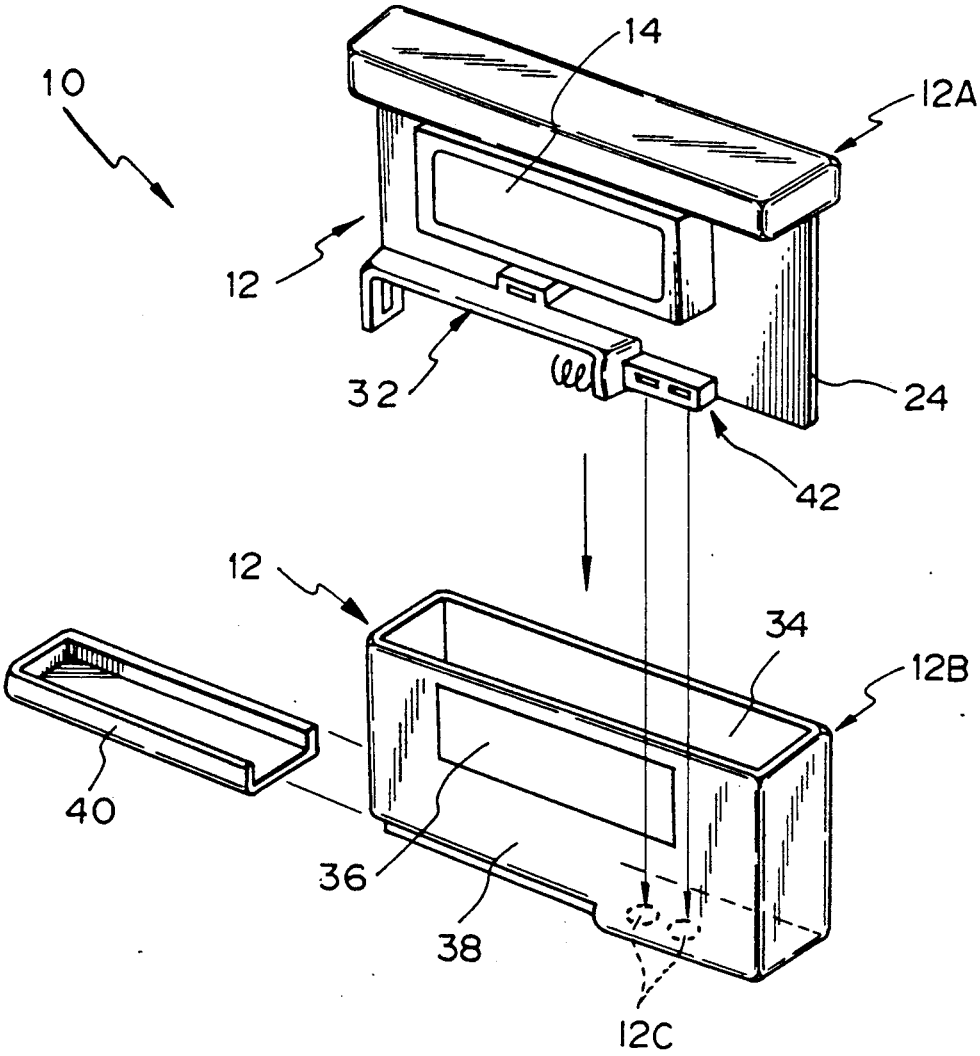
FIG. 4 is an exploded perspective view of a casing of a paging receiver in accordance with the present invention.

First, the construction of a paging receiver incorporating the illustrative embodiment, particularly the structure of a casing thereof, will be described. As shown in FIG. 4, a paging receiver 10 has a casing 12 which is generally made up of a cover part 12A and a box-like part 12B. The cover part 12A holds a display 14 and a printed circuit board 24 thereon and has a battery containing portion 32. The box-like part 12B has an opening 34 to be closed by the cover part 12A, an opening 36 corresponding in position to the display 14, an opening 38 to be closed by a battery cover 40, and windows 12*c* through which contact terminals 28 of a printer 16 will be passed. A portion 42 is formed integrally with the battery containing portion 32 of the cover part 12A for retaining connecting pieces of an output terminal, which will be described.

Figure 5:
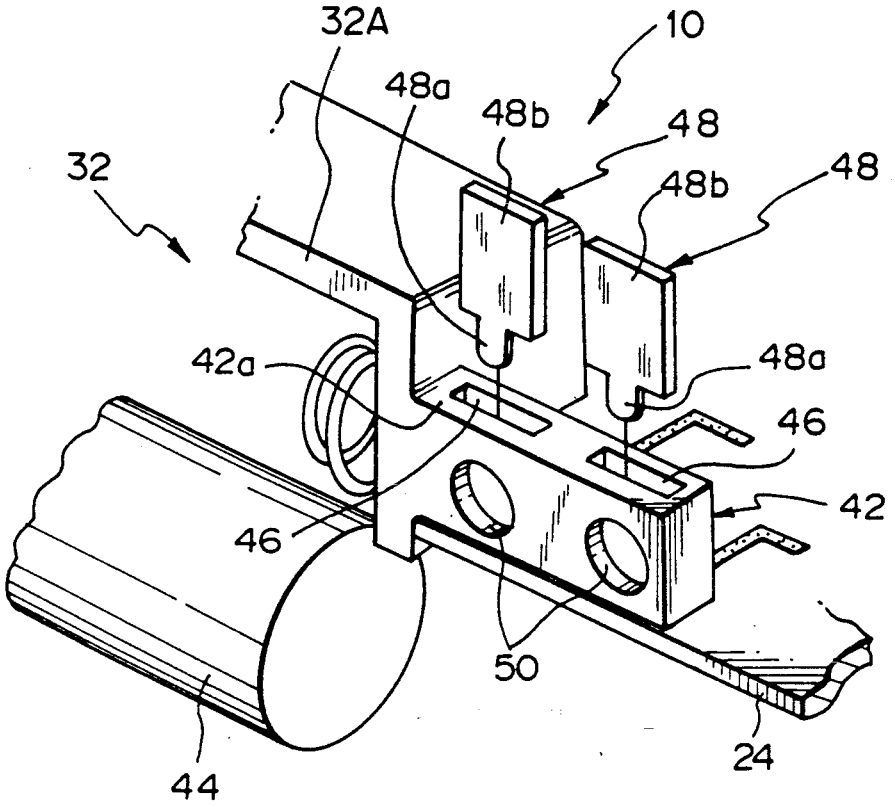
FIG. 5 is a fragmentary exploded perspective view of an output terminal structure embodying the present invention.
Figure 6:
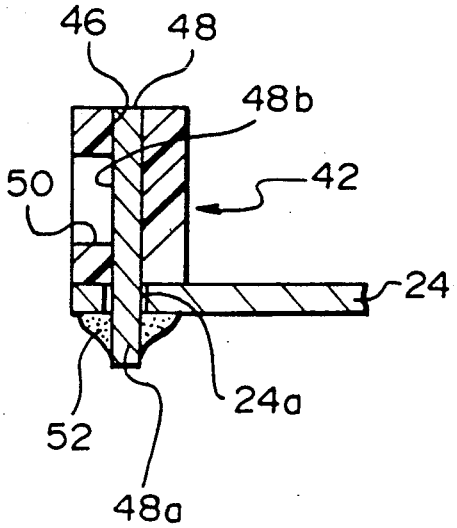
FIG. 6 is a fragmentary section of the output terminal structure shown in FIG. 5.

Referring to FIGS. 5 and 6, the retaining portion 42 mentioned above will be described in detail. As shown, the retaining portion 42 is contiguous with a part of a case 32A which forms the battery containing portion 32. A battery 44 is received in the battery containing portion 32. The retaining portion 42 extends along one edge of a printed circuit board 24 and has a pair of slots 46 each having a relatively small width. The slots 46 are open at one end 42*a* of the retaining portion 42, as illustrated. Connecting pieces 48 constitute an output terminal for electrically connecting the paging receiver 10 to the printer 16, and each is implemented as a thin flat piece of metal. The slots 46 are provided with substantially the same width as the connecting pieces 48 in order to receive the pieces 48 therein. Each connecting piece 48 has a single leg 48*a* and a contact surface 48*b*. Circular windows 50 are formed through the retaining portion 42 so that the contact surfaces 48*b* of the connecting pieces 48 may show themselves through the windows 50 when inserted in the slots 46. As shown in FIG. 6, when the connecting pieces 48 each is inserted in one of the slots 46, the leg 48*a* extending out from the connecting piece 48 is received in one of rectangular holes 24*a* which are formed through the printed circuit board 24. In this position, the leg 48*a* is soldered to the printed circuit board 24 as at 52, whereby the connecting piece 48 is electrically connected to the circuitry provided on the board 24.

Figure 7:
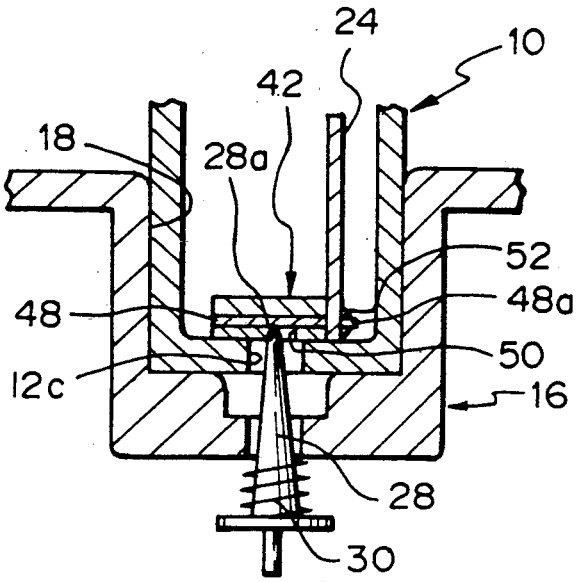
FIG. 7 is a section showing the paging receiver with the output terminal structure of FIGS. 5 and 6 in a position loaded on a printer.

FIG. 7 shows the paging receiver 10 which is received in the printer 16 with the connecting pieces 48 being firmly retained by the retaining portion 42. As shown, the printer 16 has contact terminals 28 each being constantly biased upward by a spring 30 as viewed in FIG. 7. The tip 28*a* of each contact terminal 28 abuts against the contact surface 48*b* of one of the connecting pieces 48 through one of the windows 12*c* of the box-like part 12*b* of the casing 12 and one of the windows 50 of the retaining portion 42 which are aligned with each other, thereby setting up electrical connection of the receiver 10 and printer 16. In this condition, information received by the paging receiver 10 may be printed out in alphanumeric characters, for example, on a paper sheet 22 by the printer 16.

As stated above, each connecting piece 48 having a simple flat configuration is inserted in one of the slots 46 of the retaining portion 42 and then has its single leg 48*a* soldered to the printed circuit board 24. The illustrative embodiment, therefore, eliminates the need for connecting pieces each being bent in a U configuration and provided with a number of legs. Further, the connecting pieces 48 are firmly retained by the retaining portion 42 which is contiguous with the case 32A of the battery containing portion 32. This frees the connecting pieces 48 from deformation which would effect electrical connection, despite that their contact surfaces 48*b* are urged by the tips 28*a* of the contact terminals 28 of the printer 16.

In summary, in accordance with the present invention, the output terminal structure for a paging receiver has a retaining portion contiguous with a case of a battery containing portion of the receiver and provided with slots, and connecting pieces each being received in respective one of the slots and partly soldered to a printed circuit board. The connecting pieces are, therefore, surely and firmly held by the retaining portion. Such a connecting piece does not need a bending step otherwise required to provide it with strength or a machining step for forming a plurality of legs. This is successful in simplifying the fabricating procedure and thereby cutting down the cost. In addition, each connecting piece can be readily and accurately positioned on and firmly affixed to a printed circuit board.

Various modifications will become possible for those skilled in the art after receiving the teachings of the present disclosure without departing from the scope thereof.

What is claimed is:

1. An output terminal structure for electrically connecting a paging receiver to a printer capable of printing out information received by said paging receiver, comprising:

a receiver casing loaded with a printed circuit board thereinside and having a case of a battery containing portion;

a plurality of terminal members each having a contact surface and a single leg which is affixed to the printed circuit board and electrically connected to circuitry provided on said printed circuit board; and a retaining member formed integrally with said case of said battery contining portion and comprising slots each receiving respective one of said terminal members and windows each causing respective one of said terminal members received in said slots to show;

said contact surface of each of said terminal members contacting a contact terminal member of the printer through associated one of said windows.

2. A structure as claimed in claim 1, wherein said terminal members each comprises a thin flat piece of metal.

3. A structure as claimed in claim 1, wherein said terminal members each is received in associated one of rectangular holes formed through the printed circuit board and soldered to said printed circuit board while being electrically connected to circuitry provided on said printed circuit board.

4. A structure as claimed in claim 1, wherein said receiver casing comprises a cover part provided with said battery containing portion and the printed circuit board, and a box-like part provided with an opening to be closed by said cover part, a battery inlet contiguous with said battery containing portion, and windows each being aligned with respective one of said windows of said retaining member.

5. A structure as claimed in claim 4, wherein the contact terminal members of the printer each contacts said contact surface of associated one of said terminal members through associated one of said windows of said box-like part and associated one of said windows of said retaining member.

6. An output terminal structure of a portable apparatus comprising:

a portable apparatus casing loaded with a printed circuit board thereinside and having a case of a battery containing portion;

a member having a contact surface and a leg which is affixed to said printed circuit board and electrically connected to circuitry provided on said printed circuit board; and a retaining member formed integrally with said case of said battery containing portion and comprising a slot receiving said terminal member and a window causing said terminal member received in said slot to show;

said contact surface of said terminal member electrically contacting the contact terminal member of an external apparatus through said window.

7. An output terminal structure of an electric apparatus comprising:

an apparatus casing loaded with an electric circuit board thereinside;

a member having a contact surface and a leg which is affixed to said electric circuit board and electrically connected to said electric circuit board; and a retaining member formed on said electric circuit board and comprising a slot receiving said terminal member and a window causing said terminal member received in said slot to show;

said contact surface of said terminal member electrically contacting the contact terminal member of an external electric apparatus through said window.

* * * * *